US007427221B2

(12) United States Patent
Blumenthal et al.

(10) Patent No.: US 7,427,221 B2
(45) Date of Patent: Sep. 23, 2008

(54) METHOD OF AND APPARATUS FOR AERATING BODIES OF WATER

(75) Inventors: John Blumenthal, Owings Mills, MD (US); Charles Gamber, Sr., Sykesville, MD (US)

(73) Assignee: The Power House, Owings Mills, MD (US)

( * ) Notice: Subject to any disclaimer, the term of this patent is extended or adjusted under 35 U.S.C. 154(b) by 703 days.

(21) Appl. No.: 10/647,895

(22) Filed: Aug. 26, 2003

(65) Prior Publication Data

US 2004/0112270 A1 Jun. 17, 2004

Related U.S. Application Data

(60) Provisional application No. 60/405,705, filed on Aug. 26, 2002.

(51) Int. Cl.
*B63H 11/00* (2006.01)

(52) U.S. Cl. ..... 440/39; 405/61; 417/14

(58) Field of Classification Search ..... 440/39, 440/40, 67, 113; 114/40–43, 382; 210/241, 210/242.1, 242.2, 747; 261/84, 93, 121.1, 261/123, 124, DIG. 75; 405/61; 417/14
See application file for complete search history.

(56) References Cited

U.S. PATENT DOCUMENTS

| | | | | | |
|---|---|---|---|---|---|
| 2,825,541 | A | * | 3/1958 | Moll et al. | 261/29 |
| 3,717,115 | A | * | 2/1973 | Abendroth | 114/42 |
| 3,855,367 | A | * | 12/1974 | Webb | 261/77 |
| 4,247,261 | A | * | 1/1981 | Springston | 417/14 |
| 4,439,060 | A | * | 3/1984 | Liscio | 405/61 |
| 4,587,064 | A | * | 5/1986 | Blum | 261/37 |
| 4,723,498 | A | * | 2/1988 | Stampe | 114/102.1 |
| 5,022,987 | A | * | 6/1991 | Wells | 210/173 |
| 5,868,091 | A | * | 2/1999 | Gross et al. | 114/61.1 |

* cited by examiner

*Primary Examiner*—Stephen Avila
(74) *Attorney, Agent, or Firm*—Lowe Hauptman Ham & Berner LLP

(57) ABSTRACT

A body of water is aerated by propelling in the body of water a water pumping arrangement including a sheath having a turning propeller that (a) sucks water from the body into the sheath interior via openings in the sheath, (b) forces the sucked water upwardly and (c) forces the upwardly forced water through another opening in the sheath below the surface of the body of the water. Water forced through the another opening (i) has speed greater than the speed of the water sucked into the sheath and (ii) causes air bubbles to be induced in the water above the another opening.

17 Claims, 6 Drawing Sheets

METHOD OF AND APPARATUS FOR AERATING BODIES OF WATER

RELATION TO CO-PENDING APPLICATION

The present application is a continuation-in-part of our co-pending provisional application Serial No. 60/405,705, filed Aug. 26, 2002.

FIELD OF INVENTION

The present invention relates generally to a method of and apparatus for aerating bodies of water and, more particularly, to aerating bodies of water with a propelled structure that sucks water from the body into a sheath and forces the sucked water upwardly through an opening in the sheath below the water surface so that water forced through the opening has greater speed than water sucked through the opening to cause air bubbles to be induced in the water above the opening.

BACKGROUND ART

It is known that a body of water can be purified by having air circulated through the water, that is, by aeration. Springston, U.S. Pat. No. 4,247,261 (incorporated herein by reference), discloses a structure which has been used to purify water in relatively small bodies of water, such as ponds and fish hatcheries. The Springston patent discloses a Venturi-type water pumping device which is immersible in a body of water. The device includes a sheath formed as a hollow, generally cylindrical housing having opposite outwardly flared ends. A propeller and electric drive motor mounted in the housing cause water to flow through the interior of the cylindrical housing. When used for water purification in such small bodies of water, structures of the type the Springston patent discloses are carried by moored floats such that the propeller axis and drive shift are generally vertically oriented and the upper edge of the cylindrical housing is a few inches below the water surface. Water from the body of water being purified is sucked by the propeller to flow through the lower end of the cylindrical housing as well as openings in a wall of the housing between the opposite outwardly flared ends. The water flows through the upper end of the cylindrical housing and to the surface of the body of water with sufficient velocity to be aerated as a result of bubbles being induced in the water. The foregoing structure has been found to provide satisfactory aeration for the relatively small bodies of water but it is not effectively used in larger bodies of water such as creeks, inlets, rivers, harbors, bays, etc., because the number of such moored floating structures required to purify the larger bodies of water would be very large, resulting in significant expenses due to capital and operating costs.

SUMMARY OF THE INVENTION

According to one aspect of the invention, a body of water is aerated by propelling in the body of water a water pumping arrangement including a sheath having a turning propeller that (1) sucks water from the body into the sheath interior via at least one opening in the sheath, (2) forces the sucked water upwardly and (3) forces the upwardly forced water through another opening in the sheath below the surface of the body of the water. The propeller and sheath force the water through the another opening with speed greater than the speed of the water sucked into the sheath and cause air bubbles to be induced in the water above the another opening.

Preferably, the propeller turns about an axis tilted at an angle in the range of 45° to 90° (and more preferably 60° to 90°) relative to the surface of the body of water. The sheath is preferably propelled forward at a speed no greater than about five knots, and more preferably at a speed between two and three knots.

The water pumping arrangement preferably includes a plurality of the sheaths each having a turning propeller causing steps (1), (2) and (3) to be performed relative to the sheath in which the propeller is turning.

One of the sheaths is positioned so that the propeller thereof turns about an axis that is inclined relative to the water surface at an angle that is substantially less than the inclination angle of turning propellers of others of the sheaths. The water is forced by the propeller of said one sheath through the another opening of said one propelled sheath in the propelled direction of others of the sheaths. The water forced through the another opening of said one sheath interacts with water forced through the another opening of at least some of the other sheaths located in front of the one sheath. Hence, water propelled from the one sheath pushes forward water propelled from at least some of the other sheaths.

Preferably, at least some of the other sheaths and the one sheath have outlets at about the same distance below the surface of the water; the outlets are preferably about four to six inches below the water surface. The inlets of the plural sheaths are preferably about 24 to 30 inches below the water surface if the water body has a depth of less than about ten feet. If the water body has a depth of greater than about ten feet, the inlets of the plural sheaths are preferably about 60 to 66 inches below the water surface.

Another aspect of the invention relates to a water craft adapted to be propelled. The craft includes a water pumping arrangement including a sheath carried by the craft; the sheath includes a propeller adapted to be turned. The sheath, water craft and propeller are arranged for causing the propeller while turning to (1) suck water from the body into the sheath interior via at least one opening in the sheath, (2) force the sucked water upwardly and (c) force the upwardly forced water through another opening in the sheath below the surface of the body of the water for causing the water forced through the another opening to (i) have a speed greater than the speed of the water sucked into the sheath and (ii) cause air bubbles to be induced in the water above the another opening.

The water pumping apparatus preferably includes a plurality of the sheaths each including a propeller adapted to be turned. The sheaths, water craft and propellers are arranged for causing the propeller while turning to (1) suck water from the body into the sheath interior via at least one opening in the sheath, (2) force the sucked water upwardly and (c) force the upwardly forced water through another opening in the sheath below the surface of the body of the water for causing the water forced through the another opening to (i) have a speed greater than the speed of the water sucked into the sheath and (ii) cause air bubbles to be induced in the water above the another opening. One of the sheaths is positioned so that the propeller thereof is adapted to turn about an axis that is inclined relative to the water surface at an angle that is substantially less than the inclination angle of propellers of others of the sheaths.

The sheaths and propellers are preferably arranged for causing (1) the water forced by the propeller through the another opening of said one sheath to be propelled in the propelled direction of the sheaths, and (2) interact with water forced through the another opening of at least one of the other sheaths located in front of the one sheath so the water propelled from the one sheath pushes forward water propelled from the at least one of the other sheaths.

The water craft preferably includes a first structure for carrying a plurality of the sheaths on opposite sides of and outboard of the craft. The structure preferably includes a boom arrangement for carrying the plural sheaths. Preferably, the boom arrangement is pivotable relative to a longitudinal axis of the watercraft for enabling the boom arrangement to be stowed on the craft without extending over the sides of the craft while the craft is being stowed or towed.

The craft preferably includes a second structure for carrying at least one of the sheaths forward of the forward end of the craft. The second structure is preferably pivotable relative to the longitudinal axis of the craft. A third structure preferably carries a further one of the sheaths between the first and second structures. The third structure is arranged for carrying the further one of the sheaths approximately along a longitudinal center axis of the craft. The first and second structures are preferably arranged for carrying the sheaths thereof so longitudinal axes of the sheaths thereof and drive shafts of the propellers thereof are generally vertically disposed. The third structure is arranged for carrying the further sheath so the longitudinal axis of the sheath thereof and the drive shaft of the propeller thereof are generally horizontally disposed. The second and third structures are arranged for causing water propelled from the further sheath to be pushed forward of the craft and incident on water propelled from at least one sheath on the second structure.

Flexible vertically extending connectors are preferably between the sheaths and the first, second and third structures.

The water craft is preferably a catamaran for stability.

It is, accordingly, an object of the present invention to provide a new and improved method of and apparatus for aerating bodies of water, particularly bodies of water such as creeks, inlets, rivers, harbors, bays, etc.

DETAILED DESCRIPTION OF THE DRAWINGS

Figure 1:
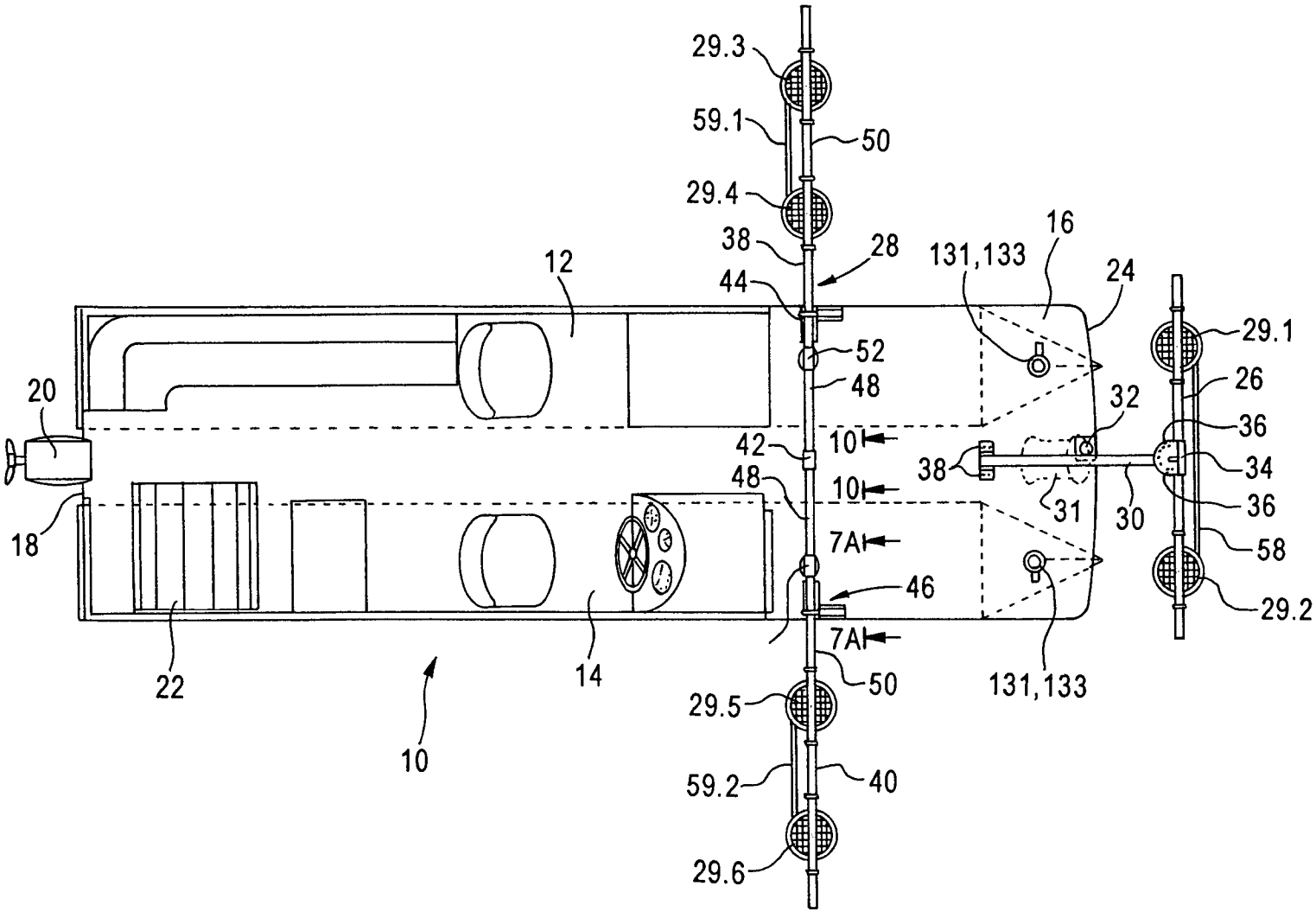
FIGS. 1, 2 and 3 are respectively top, side and front views of a catamaran including a preferred embodiment of the present invention.
Figure 2:
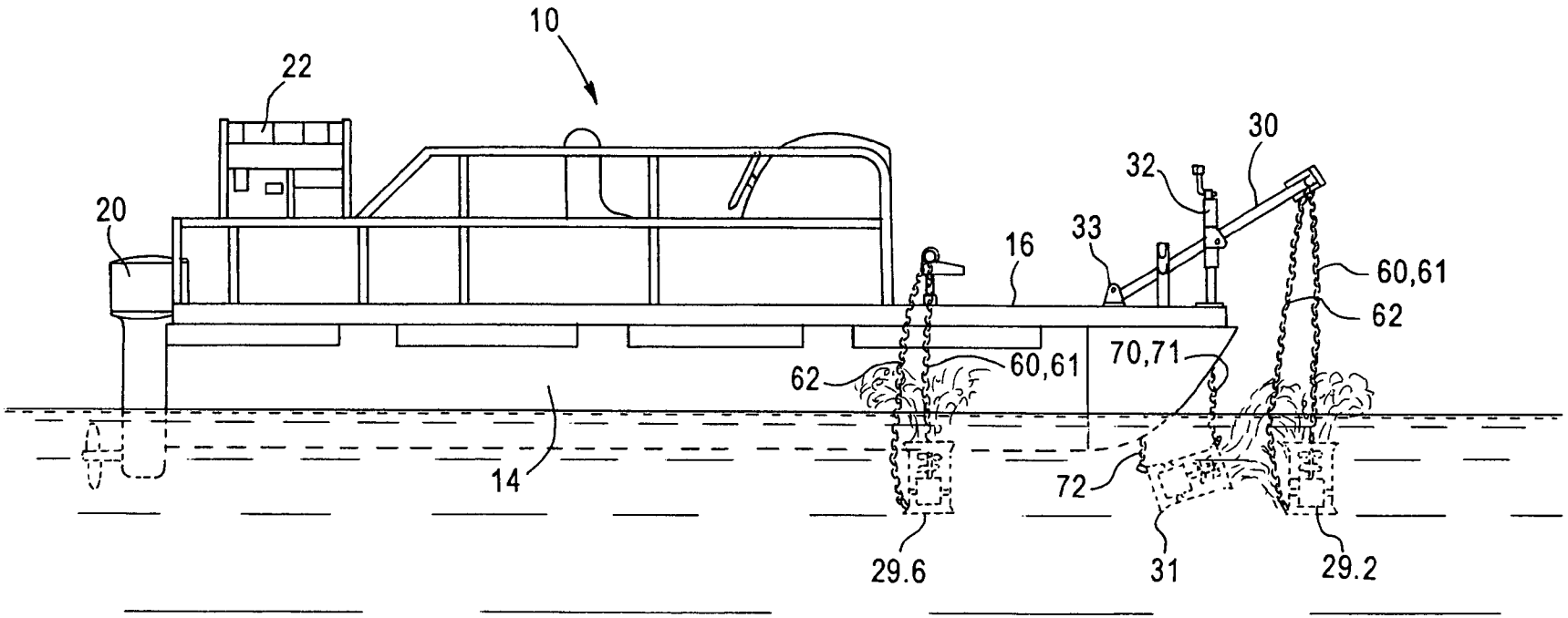
Figure 3:
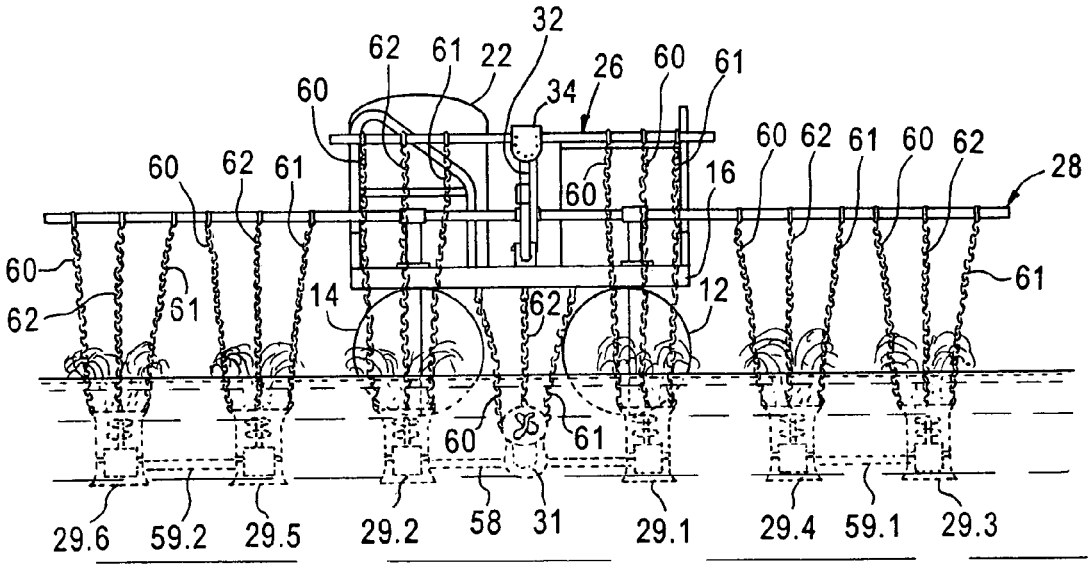

Reference is now made to FIGS. 1-3 of the drawing wherein catamaran 10 is illustrated as including port hull 12 and starboard hull 14, connected together by rigid platform 16, having an aft end 18 where outboard motor 20 and electric AC generator 22 are mounted. Platform 16 carries booms 26 and 28, respectively positioned in front of forward end 24 of platform 16 and approximately one-third of the way between forward end 24 and aft end 18. Boom 26 has a length approximately equal to the width of the platform 16 between the port and starboard sides of the platform, such that opposite ends of boom 26 are approximately aligned with the port and starboard sides of catamaran 10. In contrast, boom 28, in the deployed position illustrated in FIGS. 1-3, has a length such that each of the opposite ends of the boom extends substantially beyond the port and starboard sides of catamaran 10.

Each of booms 26 and 28 carries plural Venturi-type water pumping devices 29 preferably similar to the type disclosed in the previously mentioned patent. Water pumping devices 29 function as aerators for water in the body of water being traversed by catamaran 10. In addition, the forward end of platform 16 carries a Venturi-type water pumping device 31 (also preferably of the type disclosed in the previously mentioned patent) between hulls 12 and 14, such that pumping device 31 is approximately aligned with the longitudinal axis of platform 16 and is thus approximately equidistant between hulls 12 and 14.

Each of Venturi-type water pumping devices 29 and 31 preferably is constructed identically, as illustrated in FIGS. 5A-5D. In particular, each of the water pumping devices includes a cylindrical sheath 68 having a longitudinal axis 80 and flared opposite ends 81 and 82. Typically, sheath 68 has a length of about 2 feet and a diameter of about 18 inches. Bracket 84, including spider arms 85, is fixedly mounted on the interior wall of sheath 68 and carries waterproof single phase AC electric motor 78, connected by waterproof electric cable 87 to generator 22. Motor 78 includes output shaft 73 which is aligned with axis 80 and carries dual propellers 74 and 76 which are disposed longitudinally along shaft 73. Propellers 74 and 76 are substantially the same and are mounted on shaft 73 so they turn in the same direction and have the same pitch angle relative to the shaft. Sheath 68 includes four circular openings 86 (three of which are illustrated) through which water is sucked by propellers 74 and 76 turning to induce turbulent flow and substantial bubbling of water pumped by pumping devices 29 and 31 on the surface of the body of water being traversed by catamaran 10. Typically, motor 78 has a rating of 1/20 to 3 horsepower and is able to turn shaft 73 and propellers 74 and 76 at a speed of about 1800 RPM while water pumping devices 29 and 31 are submerged and catamaran 10 is moving forward at a speed of about three knots.

In response to propellers 74 and 76 turning, water is sucked into the interior through openings 82 and 86 from the body of water being traversed by sheaths 68. Propellers 74 and 76 upwardly propel through sheaths 68 the water sucked through openings 82 and 86 so the water is expelled through openings 81 which are maintained below the surface of the water body being traversed. The water flows through openings 81 at a speed substantially greater than the water sucked through openings 82 and 86 as a result of the Venturi effect to cause bubbling and aeration above openings 81 of the water body being traversed by propelled sheaths 68.

To prevent vegetable and marine material in the body of water being purified by catamaran 10 from fouling propellers 74 and 76, flared ends 81 and 82 are respectively covered by grids 88 and 90. Grid 88 is pivotable with respect to the edge of flared end 81 to enable access to propellers 74 and 76 (for cleaning) and to motor 78 for maintenance, while grid 90 is fixedly mounted on flared end 82. In normal operation, when sheath 68 is submerged, grid 88 is held in place by a keeper (not shown).

Chains 60-62 flexibly connect pumping devices 29 to booms 26 and 28 such that shafts 73 of devices 29 are generally vertically oriented, while chains 70-72 flexibly connect pumping device 31 to platform 16, such that shaft 73 of device 31 is generally horizontal with respect to the surface of the water, but has a tilt angle of approximately 30 degrees with respect to the water surface. Links at the bottom ends of chains 60 and 61, as well as at the bottom ends of chains 70 and 71, fit into hooks 92 and 94 secured to the flared end 81 of each of sheaths 68, while links at the bottom ends of chains 62 and 72 fit into hooks 96, secured to the flared end 82 of each of sheaths 68. Hooks 92 and 94 are diametrically opposed to each other while hook 96 is equidistant from hooks 92 and 94. Hooks 92-96 are closed after the bottom links of chains 60-62 and 70-72 are inserted into the hooks, so that the chains securely hold pumping devices 29 and 31 in place. The flexible connection provided by chains 60-62 and 70-72 between pumping devices 29 and 31 and catamaran 10 enables the pumping devices to move and give relative to the catamaran when the pumping devices strike an object or the floor of the water body being traversed.

Figure 6:
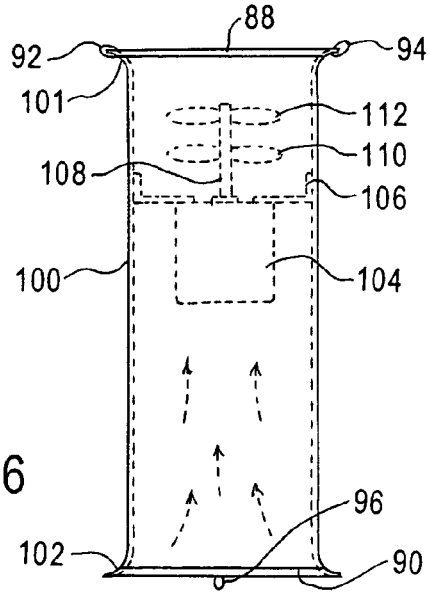
FIG. 6 is a side view of a modified Venturi-type water pumping device that can be employed in the catamaran of FIGS. 1-3, wherein the water pumping device is particularly adapted for use in relatively deep bodies of water.

The pumping devices illustrated in FIGS. 5A-5D are particularly adapted for aerating and therefore oxygenating bodies of water that are relatively shallow, having a depth no greater than about ten feet. To aerate bodies of water that are deeper than about ten feet, pumping devices 29 that are mounted on booms 26 and 28 are preferably of the type illustrated in FIG. 6. The pumping device of FIG. 6 is similar to the pumping device of FIGS. 5A-5D, except that the device of FIG. 6 includes sheath 100 having a length that is considerably longer than the length of sheath 68 and sheath 100 does not include openings similar to openings 86 in sheath 68. Typically, sheath 100 has a length of approximately five feet between its top and bottom flared edges 101 and 102. Sheath 100 carries electric motor 104, bracket 106, shaft 108 and propellers 110 and 112 in the same position with respect to flared end 101 as the corresponding parts are carried by and located in sheath 68 with respect to flared end 81.

Pole 30, having opposite aft and forward ends respectively connected to platform 16 and boom 26, fixedly secures boom 26 to the platform. The forward end of pole 30 is mounted for turning in a vertical plane with respect to the deck of platform 16 by a pivotable connection of the inboard end of the pole to posts 33. Pole 30 extends horizontally (along the center line of platform 16) and vertically with respect to platform 16 such that boom 26, in a typical position, is approximately three feet in front of and three feet above the forward end 24 of platform 16. The vertical angle of pole 30 with respect to platform 16 is adjustable by virtue of a center portion of pole 30 being connected to post 32 that can be raised and lowered with respect to platform 16. The boom 26 can be turned with respect to the longitudinal axis of pole 30 by virtue of boom 26 being mounted on connector 34 that is connected to the forward end of pole 30 and can be turned about a transverse axis of pole 30. Connector 34 includes a multiplicity of openings 36 which can engage and fit into a stud (not shown) carried on and extending from the upper surface of pole 30 to enable the boom 26 to turn with respect to the transverse axis of the pole.

Figure 4:
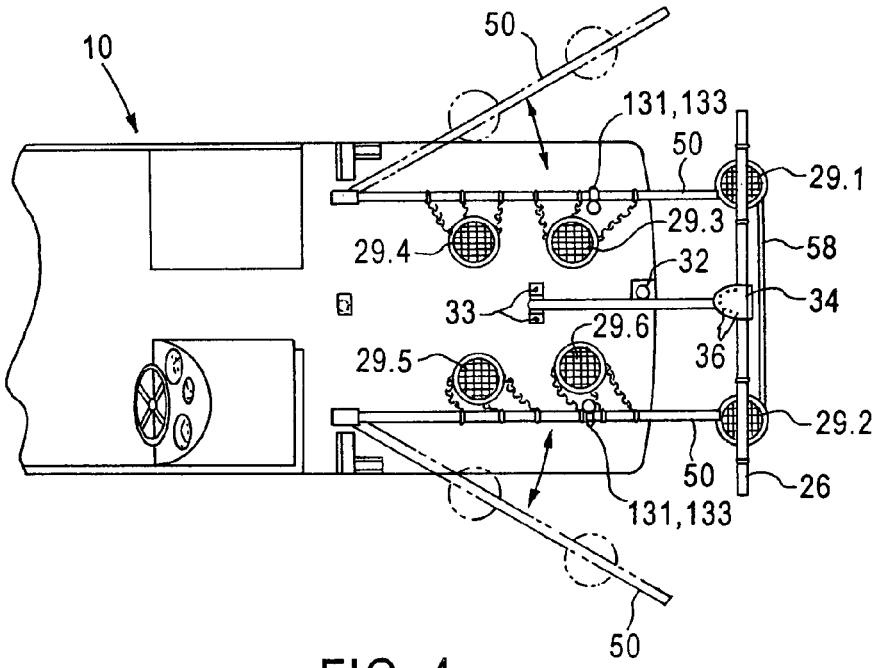
FIG. 4 is a top view of the catamaran illustrated in FIGS. 1, 2 and 3 wherein booms carrying aerating structures are in a folded position.
Figure 5A:
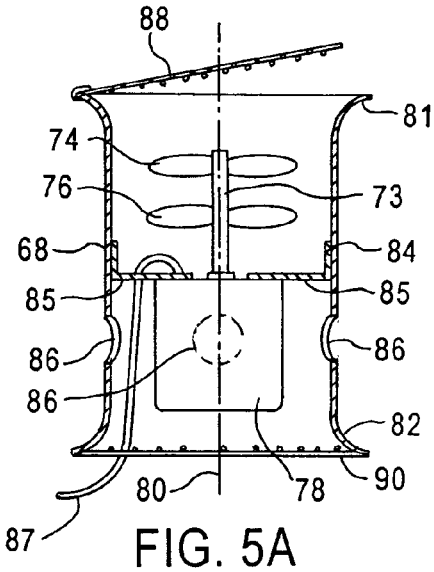
FIG. 5A is a side sectional view of a preferred embodiment of a Venturi-type water pumping device employed in the catamaran of FIGS. 1-4.
Figure 5D:
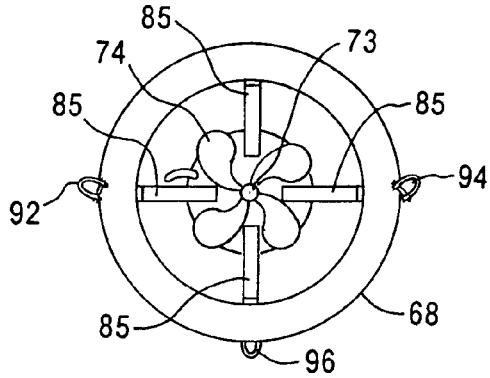
FIG. 5D is a top view of the water pumping device illustrated in FIG. 5A, with the top screen removed.
Figure 5B:
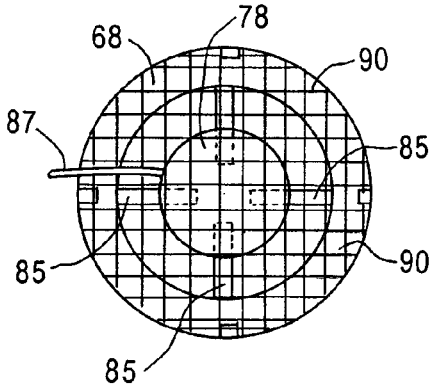
FIG. 5B is a bottom view of the water pumping device illustrated in FIG. 5A.
Figure 5C:
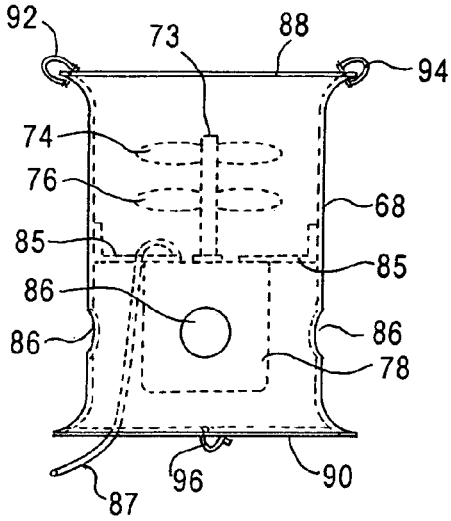
FIG. 5C is a side view of the water pumping device illustrated in FIG. 5A.
Figure 7A:
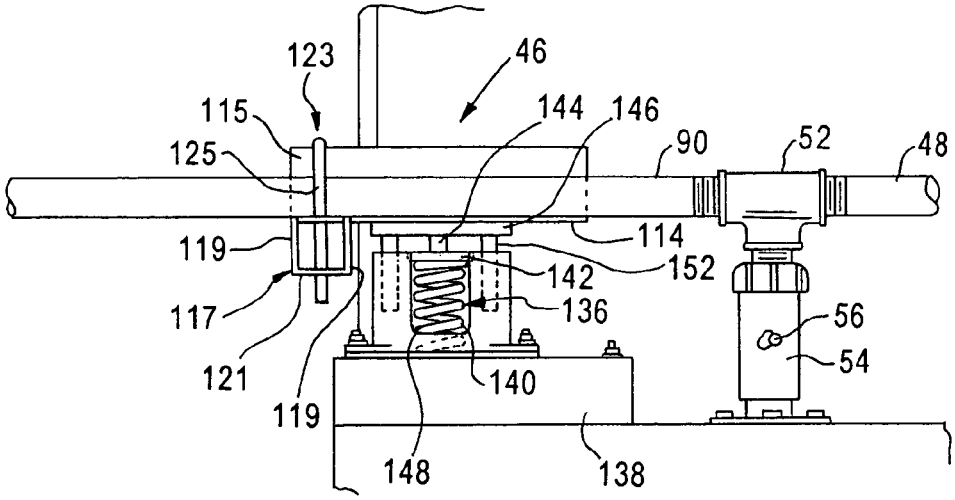
FIG. 7A is a front view of a mounting device for a boom employed on the catamaran of FIGS. 1-3, in combination with a portion of the boom.

Boom 28, that extends in a direction parallel to the plane of the deck of platform 16 and at right angles to the longitudinal axis of the deck, includes port and starboard segments 38 and 40, respectively. In the deployed position of boom 28, as illustrated in FIGS. 1-3, coupling cylinder 42 (FIGS. 10 and 10A) fixedly connects the inboard ends of segments 38 and 40 together, approximately on the longitudinal axis of the deck of platform 16. In the deployed position, port and starboard segments 38 and 40 are respectively held in place above the deck of platform 16 by identical holding assemblies 44 and 46, respectively fixedly mounted in immediate proximity to the port and starboard sides of platform 16. Details of one of holding assemblies 44 or 46 are illustrated in FIG. 7A, and described infra. Each of boom segments 38 and 40 includes an inboard portion 48 and outboard portion 50, connected to each other by T connector 52 (FIG. 7A) that is carried by vertically extending stud post 54, fixedly mounted on the deck of platform 16. To enable catamaran 10 to be (1) loaded onto a trailer for transport on highways and (2) used to aerate water in close quarters, boom 26 can be partially disassembled and turned to the position illustrated in FIG. 4, such that segments 38 and 40 are turned forward relative to platform 16. To this end, inboard portions 48 are disconnected from coupling cylinder 42 and connectors 52 and the inboard portions are stowed on catamaran 10. Pin 56 (FIG. 7A) is removed from a hole in each of posts 54 to enable the post and segments 50 to be turned so segments 50 extend parallel to the longitudinal axis of platform 16, resulting in the ends of segments 50 being in proximity to and aft of boom 26, as well as below boom 26.

Forward boom 26 carries a pair of the Venturi-type water pumping devices 29.1 and 29.2, respectively located on the port and starboard sides of catamaran 10 so they are approximately equidistant from pole 30. Rigid strut 58, having opposite ends fixedly connected to water pumping devices 29.1 and 29.2, maintains a constant spacing, in the horizontal plane, between devices 29.1 and 29.2. Boom 28 carries four Venturi-type water pumping devices 29.3, 29.4, 29.5 and 29.6, such that devices 29.3 and 29.4 are mounted on outboard portion 50 of port segment 38 of boom 28 and devices 29.5 and 29.6 are mounted on outboard portion 50 of starboard segment 40 of boom 28. Rigid struts 59.1 and 59.2 maintain constant spacings, in the horizontal plane, between devices 29.3 and 29.4 and between devices 29.5 and 29.6, respectively.

Figure 9:
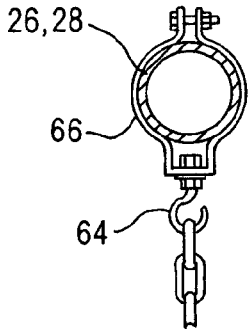
FIG. 9 is a view taken through the lines 9-9, FIG. 8.

Three chains 60-62 flexibly connect each of water pumping devices 29.1-29.6 to booms 26 and 28. Chains 60 and 61 are respectively connected to hooks 92 and 94 that are diametrically opposed to each other at flared end 81 of sheath 68, while chain 63 is connected to hook 96 at flared end 82 of the sheath. Hence, chains 60 and 61 are connected to top portions of water pumping devices 29.1-29.6, while chains 62 are connected to bottom portions of water pumping devices 29.1-29.6. Each of chains 60-62 is fixedly mounted on boom 26 or 28 by a separate hook assembly 64 (FIG. 9) which fits through a link of the chain. Each of hook assemblies 64 is carried by a separate ring assembly 66 which fits around and is secured to the periphery of boom 26 or 28.

The lengths of chains 60 and 62 are such that water pumping devices 29.1-29.6 are generally vertically disposed in the body of water, with the upper water outlet edge of generally cylindrically shaped sheaths 68 (FIGS. 5B, 5C and 5D) approximately four to six inches below the surface of the body of water being aerated. Water pumping devices 29.1-29.6 are constructed so that when the upper edges of the sheaths 68 thereof are approximately four to six inches below the water surface and the sheaths are vertically oriented, water pumped through the sheaths bubbles to and above the quiescent surface of the body of water with sufficient velocity to be aerated. In certain situations, it is desirable for any of water pumping devices 29.1-29.6 to be positioned so that the longitudinal axis of sheath 68, which is coincident with the motor drive shaft 73, thereof is oriented in a plane other than the vertical plane. In such situations, the length of chain 62 is adjusted to control the angle of the longitudinal axis of sheath 68 relative to the surface of the water body. In tests, we found that optimum results are attained when the angle of shaft 73 of devices 29.1-29.6 is tilted anywhere in the range of 0° to 30° from vertical (i.e., in the range of 90° to 60° from the quiescent water level), but some aeration is attained for tilt angles of shaft 73 up to 45°.

Chains 70 and 72 carry Venturi-type water pumping device 31 between hulls 12 and 14, substantially in vertical alignment with pole 30, slightly behind the forward end of platform 16. Chains 70 and 72 are connected to the lower face of platform 16 by hook arrangements similar to hook arrangement 64, FIG. 9. Chains 70 and 72 are respectively connected to the portions of sheath 68 of water pumping device 31 in proximity to propellers 74 and 76 of the water pumping device and the motor 78 of the pumping device so that the longitudinal axis 80 of sheath 68 of device 31 is somewhat horizontally disposed. The lengths of chains 70 and 72 are typically such that the portion of water pumping device 31 in proximity to propellers 74 and 76 is above the portion of device 31 in proximity to motor 78 and the angle of the longitudinal axis of sheath 68 is approximately 30 degrees relative to the surface of the water. Typically, chains 70 and 72 are adjusted so the upper edge water outlet of sheath 68 of device 31 is approximately the same distance below the surface of the water as the upper water outlet edges of the sheaths of devices 29.1-29.6.

Water pumped by pumping device 31 bubbles to and above the quiescent surface of the body of water with sufficient velocity to be aerated and directed forward of platform 16. Typically, the spacing between the forward end of pumping device 31 and pumping devices 29.1 and 29.2 is such that the bubbling induced by pumping device 31 interacts with the bubbling induced by pumping devices 29.1 and 29.2 to assist in causing the bubbles from devices 29.1 and 29.2 to be projected forward of the vertical axes of devices 29.1 and 29.2. The forward motion of catamaran 10, which typically is in the range of two to three knots for optimum results (but can be as great as five knots), assists in causing bubbles from devices 29.1 and 29.2 to be projected forward of the vertical axes of devices 29.1 and 29.2. The forward motion of the catamaran also causes bubbles from devices 29.3-29.6 to be projected forward of the vertical axes of the sheaths 68 of devices 29.3-29.6, even though the longitudinal axes 80 of sheaths 68 of devices 29.3-29.6 are approximately vertically disposed. In those cases where the axes of sheaths 68 of devices 29 are inclined relative to the surface of the water body (i.e., are not vertical), chains 60-62 hold the sheaths so the top water outlet edge 81 is positioned forward of inlet edge 82. The forward motion of catamaran 10 has a synergistic effect because it (1) induces greater bubbling and aeration of the water in the body of water being purified than is achieved by essentially stationary Venturi-type water pumping devices while (2) purifying a relatively large body of water.

To stabilize the vertical position of the outboard portions 50 of boom 28 above the surface of the body of water being traversed by catamaran 10 and thereby maintain the top edges 81 of water pumping devices 29.2-29.6 at a substantially constant depth below the water surface, the outboard portions 50 of segments 38 and 40 of boom 28 rest against and are captured by holding assemblies 44 and 46, respectively.

Figure 7B:
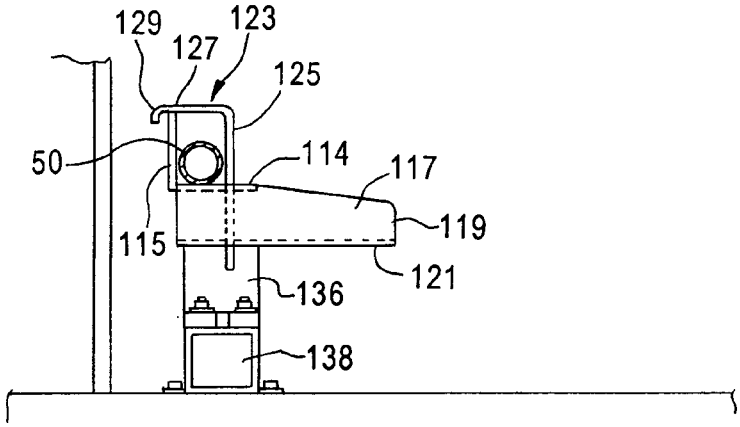
FIG. 7B is a side view of the mounting device of FIG. 7A, with the boom in the deployed position illustrated in FIGS. 1, 2 and 3.
Figure 7C:
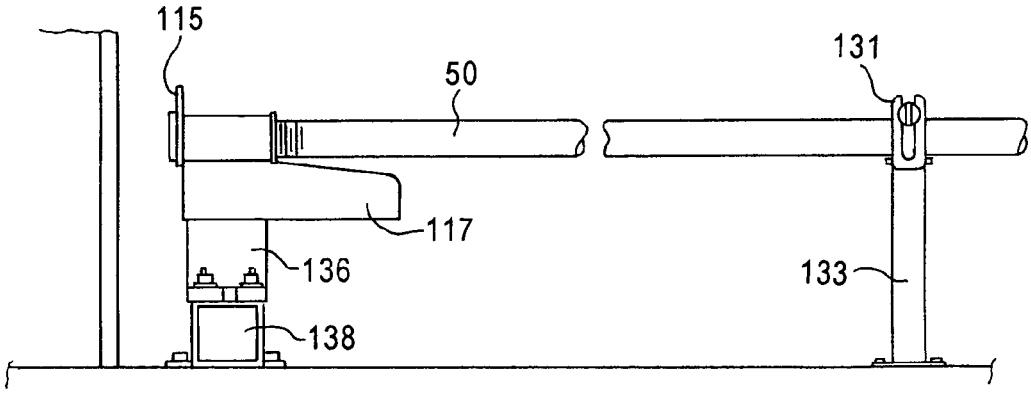
FIG. 7C is a side view of the mounting device of FIG. 7A, with the boom in the folded position illustrated in FIG. 4.
Figure 8:
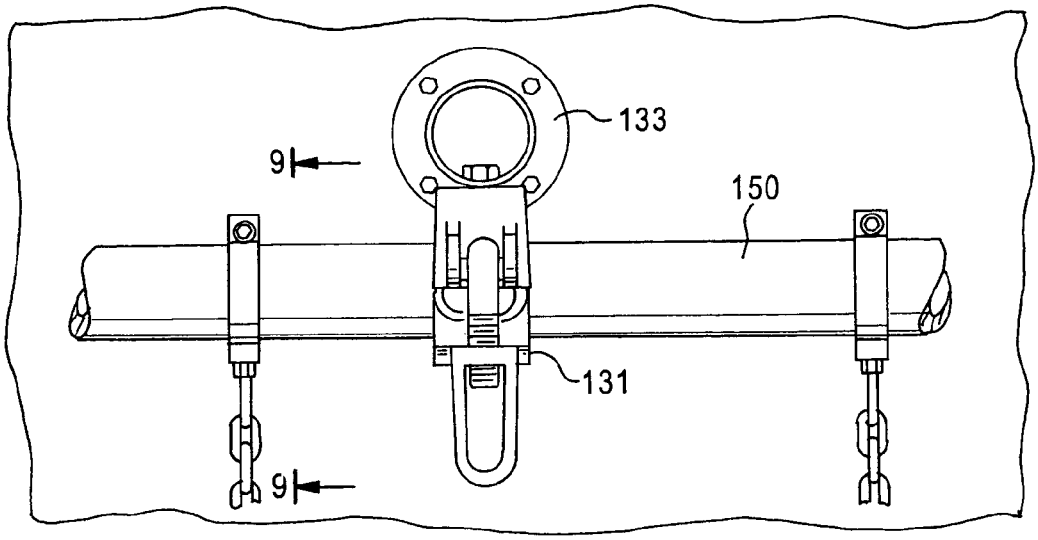
FIG. 8 is a front view of the boom included on the catamaran of FIGS. 1-4, in combination with chains for holding the Venturi-type water pumping device illustrated in FIGS. 5A-5B.

Details of holding assembly 46 in combination with outboard portion 50 of starboard segment 40, when in the deployed position, are illustrated in FIGS. 7A and 7B. Holding assembly 46 includes bracket 114 having a horizontal surface upon which boom portion 50 rests and about which boom portion 50 turns when boom 28 is not in the deployed position, as illustrated in FIG. 7C. Bracket 114 includes upwardly directed flange 115 which prevents substantial transverse motion of outboard portion 50 of boom 28 while the outboard portion is in the deployed position illustrated in FIGS. 7A and 7B. Bracket 114 includes U-shaped appendage 117 which extends downwardly from the bottom, horizontally disposed surface of the bracket so that both of the vertically extending legs 119 of the appendage are fixedly connected to the horizontal surface of bracket 114. The horizontally extending foot 121 of appendage 117 below the horizontal surface of bracket 114 includes a circular opening which is aligned with a similar opening in the horizontal surface of bracket 114. Hook shaped keeper 123, formed from a pipe, includes an elongated shank 125 that extends vertically and fits snugly in and through the circular openings in the horizontal surface of bracket 114 and foot 121 of appendage 117. Keeper 123 includes horizontally extending arm 127, having one end connected to shank 125 and a second end connected to downwardly extending finger 129. In the deployed position of outboard portion 50 of boom 28, keeper 123 and bracket 114 prevent substantial movement of the outboard portion of the boom. Prior to boom portion 50 being turned to the stowed position illustrated in FIG. 7C, boom portion 48 is disconnected and then shank 125 is pulled upwardly through the openings in bracket 114 and appendage 117. Then boom portion 50 is turned to the forward end of the catamaran and is secured to keeper 131 which is fastened to the top of post 133, fixedly mounted on platform 16 in proximity to the forward end of platform 16. FIG. 8 includes details of keeper 131 and the way the keeper is mounted to post 133 and indicates how boom portion 50 is secured to the keeper.

Spring assembly 136 carries bracket 114 and is fixedly secured to the top face of tube 138, having a square cross-section and a bottom face that is fixedly mounted to platform 16. Spring assembly 136 dampens the motion of catamaran 10 as the catamaran is moving through the water body, to stabilize the outward portions 50 of boom 28 and the top edges of water pumping devices 29.3-29.6. Spring assembly 136 includes compression spring 140 having a vertically oriented longitudinal axis such that the bottom edge of spring 140 is effectively clamped to the top face of tube 138 and the upper edge of spring 140 is effectively clamped to the bottom face of plate 142 which in turn carries vertically extending stub shaft 144. Shaft 144 carries horizontally extending plate 146, to which the bottom face of bracket 114 is secured. Spring 136 is captured in cavity 148 of housing 150 that is secured to the upper face of tube 138 and includes vertically extending bores (not shown) into which rods 152, that downwardly depend from plate 146, extend so that the rods are effectively captured in the bores, but can move vertically in response to movement of spring 136.

Figure 10:
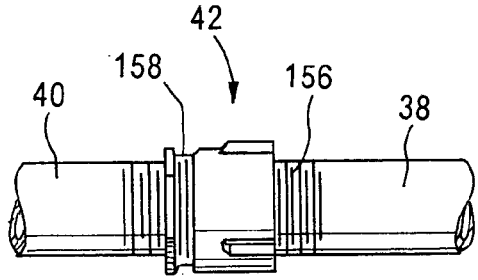
FIG. 10 is a front view of the structure for connecting the ends of a pair of the booms carried by the catamaran of FIGS. 1-3, in combination with the ends of the pair of booms.
Figure 10A:
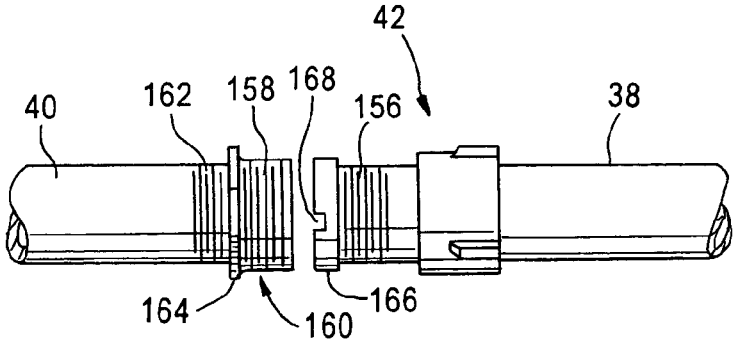
FIG. 10A is a view of the structure illustrated in FIG. 10 when the ends of the booms are disconnected from each other.

Reference is now made to FIGS. 10 and 10A which indicate details of how inboard portions 48 of port and starboard segments 38 and 40 are connected to each other when boom 28 is in the deployed position illustrated in FIGS. 1-3. Coupling cylinder 42 includes a threaded internal cylindrical surface for engaging corresponding threads 156 and 158 effectively on the outer cylindrical surfaces at the ends of inboard portions 48 of port and starboard segments 38 and 40. Threads 158 are carried by stub tube 160, having internal threads which engage threads 160 in the end of the segment 40. Stub tube 160 includes collar 164 to facilitate turning of the stub tube along segment 40. Collar 166, at the end of segments 38, includes diametrically opposed rectangular apertures 168 (only one of which is illustrated) which engage corresponding lands (not shown) on the interior of and at the end of stub tube 160 where collar 164 is located. When apertures 168 are snug against the lands at the end of stub tube 160, coupling collar 42 is turned so internal threads thereof engage and are tight against threads 156 and 158.

While there has been described and illustrated a specific embodiment of the invention, it will be clear that variations in the details of the embodiment specifically illustrated and described may be made without departing from the true spirit and scope of the invention as defined in the appended claims. For example, while the invention has been described in connection with a catamaran, which is believed to provide greater stability and better operation than a craft having a single hull, it is to be understood that the principles of the invention are also applicable to crafts having a single hull and to towed water craft; in this regard, the word "propelled" is used in the broadest sense, as structures that are caused to be actively moved forward or onward, but is not intended to cover structures that move passively, e.g., in response to wind or tidal forces. In addition, the size and shape of sheaths 68 are to be considered exemplary. Further, the speed of propeller shafts 73 can be any suitable fixed or variable value, 1800 RPM being merely a convenient value.

What is claimed is:

1. A water craft adapted to be propelled comprising a water pumping arrangement including a sheath carried by the water craft, the sheath including a propeller adapted to be turned, the sheath, water craft and propeller being arranged for causing the propeller while turning and while the water craft is moving forward in a body of water to (a) suck water from the body of water into the sheath interior via at least one opening in the sheath, (b) force the sucked water upwardly and (c) force the upwardly forced water through another opening in the sheath below the surface of the body of the water for causing the water forced through the another opening to (i) have speed greater than the speed of the water sucked into the sheath and (ii) cause air bubbles to be induced in the water above the another opening, and another opening arranged to be maintained during steady state operation of the propellers about four to six inches below the water surface while the water craft is moving forward in the body of water.

2. The water craft of claim 1 wherein the sheath and propeller are arranged so the propeller is adapted to turn about an axis tilted at an angle in the range of 60° to 90° relative to the surface of the body of water while the water craft is moving forward in the body of water.

3. The water craft of claim 1 wherein the water pumping arrangement includes a plurality of the sheaths each including a propeller adapted to be turned, the sheaths, water craft and propellers being arranged for causing the propellers while turning and while the water craft is moving forward in the body of water to (a) suck water from the body into the sheath interior via at least one opening in the sheath, (b) force the sucked water upwardly and (C) force the upwardly forced water through another opening in the sheath below the surface of the body of the water for causing the water forced through the another opening to (i) have speed greater than the speed of the water sucked into the sheath and (ii) cause air bubbled to be induced in the water above the another opening.

4. A water craft adapted to be propelled comprising a water pumping arrangement including a sheath carried by the craft, the sheath including a propeller adapted to be turned; the sheath, water craft and propeller being arranged for causing the propeller while turning to (a) suck water from the body into the sheath interior via at least one opening in the sheath, (b) force the sucked water upwardly and (c) force the upwardly forced water through another opening in the sheath below the surface of the body of the water for causing the water forced through the another opening to (i) have speed greater than the speed of the water sucked into the sheath and (ii) cause air bubbles to be induced in the water above the another opening, the water pumping arrangement including a plurality of the sheaths each including a propeller adapted to be turned; the sheaths, water craft and propellers being arranged for causing the propellers while turning to (a) suck water from the body into the sheath interior via at least one opening in the sheath, (b) force the sucked water upwardly and (c) force the upwardly forced water through another opening in the sheath below the surface of the body of the water for causing the water forced through the another opening to (i) have speed greater than the speed of the water sucked into the sheath and (ii) cause air bubbled to be induced in the water above the another opening; one of the sheath being positioned so that the propeller thereof is adapted to turn about an axis that is inclined relative to the water surface at an angle that is substantially less than the inclination angle of propellers of others of the sheaths; the sheaths and propellers being arranged for causing the water forced by the propeller through the another opening of said one sheath to be propelled in the propelled direction of the sheaths and interacting with water forced through the another opening of at least one of the other sheaths located in front of the one sheath so the water propelled from the one sheath pushes forward water propelled from the at least one of the other sheaths.

5. A water craft adapted to be propelled comprising a water pumping arrangement including a sheath carried by the water craft, the sheath including a propeller adapted to be turned, the sheath, water craft and propeller being arranged for causing the propeller while turning and while the water craft is moving forward in a body of water to (a) suck water from the body of water into the sheath interior via at least one opening in the sheath, (b) force the sucked water upwardly and (c) force the upwardly forced water through another opening in the sheath below the surface of the body of the water for causing the water forced through the another opening to (i) have speed greater than the speed of the water sucked into the sheath and (ii) cause air bubbles to be induced in the water above the another opening, a first structure carrying a plurality of the sheaths on opposite sides of and outboard of the craft.

6. The water craft of claim 5 wherein the first structure includes a boom arrangement carrying the plural sheaths.

7. The water craft of claim 6 wherein the boom arrangement is pivotable relative to a longitudinal axis of the water craft, the boom arrangement when pivoted causing the boom arrangement to be stowed on the craft without extending over the sides of the craft while the craft is being stowed or towed.

8. The water craft of claim 5 further including a second structure carrying at least one of the sheaths forward of the forward end of the craft.

9. The water craft of claim 8 wherein the second structure is pivotable relative to the longitudinal axis of the craft.

10. The water craft of claim 8 further including a third structure carrying a further one of the sheaths between the first and second structures.

11. The water craft of claim 10 wherein the third structure carries the further one of the sheaths approximately along a longitudinal center axis of the craft.

12. The water craft of claim 11 wherein the first and second structures carry the sheaths thereof so longitudinal axes of the sheaths thereof and drive shafts of the propellers thereof are generally vertically disposed and the third structure carries the further sheath so longitudinal axes of the sheaths thereof and drive shafts of the propellers thereof are generally horizontally disposed, the second and third structures being arranged for causing water propelled from the further sheath to be pushed forward of the craft and incident on water propelled from at least one sheath on the second structure.

13. A water craft adapted to be propelled comprising a water pumping arrangement including a sheath carried by the craft, the sheath including a propeller adapted to be turned; the sheath, water craft and propeller being arranged for causing the propeller while turning to (a) suck water from the body into the sheath interior via at least one opening in the sheath, (b) force the sucked water upwardly and (c) force the upwardly forced water through another opening in the sheath below the surface of the body of the water for causing the water forced through the another opening to (i) have speed greater than the speed of the water sucked into the sheath and (ii) cause air bubbles to be induced in the water above the another opening, a first structure for carrying a plurality of the sheaths on opposite sides of and outboard of the craft; a second structure for carrying at least one of the sheaths forward of the forward end of the craft, a third structure for carrying a further one of the sheaths between the first and second structures; the third structure being arranged for carrying the further one of the sheaths approximately along a longitudinal center axis of the craft; the first and second structures being arranged for carrying the sheaths thereof so longitudinal axes of the sheaths thereof and drive shafts of the propellers thereof are generally vertically disposed; the third structure being arranged for carrying the further sheath so longitudinal axes of the sheaths thereof and drive shafts of the propellers thereof are generally horizontally disposed, the second and third structures being arranged for causing water propelled from the further sheath to be pushed forward of the craft and incident on water propelled from at least one sheath adapted to be on the second structure, flexible vertically extending connectors between the sheaths and the first, second and third structures; and flexible vertically extending connectors between the sheaths and the first, second and third structures.

14. The water craft of claim 1 wherein the water craft is a catamaran.

15. The water craft of claim 1 further including a structure carrying at least one of the sheaths forward of the forward end of the craft.

16. The water craft of claim 15 wherein the structure is pivotable relative to the longitudinal axis of the craft.

17. The water craft of claim 1 further including a vertically extending flexible connector between the sheath and the craft.

* * * * *